US011060239B2

(12) United States Patent
Akechi

(10) Patent No.: US 11,060,239 B2
(45) Date of Patent: Jul. 13, 2021

(54) COATED BASE FABRIC FOR AIRBAG AND METHOD FOR MANUFACTURING SAME

(71) Applicant: TOYOBO CO., LTD., Osaka (JP)

(72) Inventor: Tsutomu Akechi, Shiga (JP)

(73) Assignee: TOYOBO CO., LTD., Osaka (JP)

( * ) Notice: Subject to any disclaimer, the term of this patent is extended or adjusted under 35 U.S.C. 154(b) by 352 days.

(21) Appl. No.: 16/061,610

(22) PCT Filed: Dec. 8, 2016

(86) PCT No.: PCT/JP2016/086525

§ 371 (c)(1),
(2) Date: Jun. 12, 2018

(87) PCT Pub. No.: WO2017/104529

PCT Pub. Date: Jun. 22, 2017

(65) Prior Publication Data

US 2020/0024798 A1 Jan. 23, 2020

(30) Foreign Application Priority Data

Dec. 16, 2015 (JP) ..... JP2015-244913

(51) Int. Cl.
*D06N 3/12* (2006.01)
*D06N 3/00* (2006.01)

(52) U.S. Cl.
CPC ..... *D06N 3/128* (2013.01); *D06N 3/0006* (2013.01); *D06N 3/0088* (2013.01); *D06N 2211/268* (2013.01)

(58) Field of Classification Search
None
See application file for complete search history.

(56) References Cited

U.S. PATENT DOCUMENTS 5,700,870 A * 12/1997 Mueller ..... B60R 21/235 524/837
8,815,757 B2 * 8/2014 Akechi ..... D03D 1/02 442/286

(Continued)

FOREIGN PATENT DOCUMENTS

CN 103122588 A 5/2013
EP 3323919 5/2018

(Continued)

OTHER PUBLICATIONS

Office Action dated Jan. 3, 2020 for CN patent application No. 201680073148.5.

(Continued)

*Primary Examiner* — Arti Singh-Pandey
(74) *Attorney, Agent, or Firm* — Fish & Richardson P.C.

(57) ABSTRACT

Provided is a coated fabric for airbags that exhibits a small variation in air permeability of the fabric in the width direction, and a method for producing a coated fabric for airbags capable of reducing the variation in air permeability. The coated fabric for airbags includes a woven fabric composed of synthetic fiber filaments and has an elastomer resin applied to one surface thereof, the coated fabric having an air permeability in the width direction of the coated fabric such that the maximum value of the air permeability is 1.5 times the average value or less.

9 Claims, 1 Drawing Sheet

(56) References Cited

U.S. PATENT DOCUMENTS

| | | | | |
|---|---|---|---|---|
| 9,732,465 | B2 * | 8/2017 | Akechi | D06N 3/0043 |
| 9,790,624 | B2 * | 10/2017 | Akechi | D06N 3/0006 |
| 2015/0017859 | A1 | 1/2015 | Akechi et al. | |
| 2015/0115574 | A1 * | 4/2015 | Enoki | D06N 3/0034 280/728.1 |
| 2016/0273157 | A1 | 9/2016 | Akechi | |
| 2017/0136982 | A1 | 5/2017 | Akechi | |
| 2018/0208147 | A1 * | 7/2018 | Yokoi | D03D 1/02 |

FOREIGN PATENT DOCUMENTS

| | | | |
|---|---|---|---|
| JP | 2001-071847 | | 3/2001 |
| JP | 2004-308076 | A | 11/2004 |
| JP | 2007-535432 | | 12/2007 |
| JP | 2008-081873 | | 4/2008 |
| JP | 4423853 | B2 | 12/2009 |
| WO | 2005/108671 | | 11/2005 |
| WO | 2013/118755 | | 8/2013 |
| WO | 2014/148459 | | 9/2014 |
| WO | 2015/151358 | | 10/2015 |
| WO | 2017/010458 | | 1/2017 |

OTHER PUBLICATIONS

Extended European Search Report dated Jun. 3, 2019 for European patent application No. 16875509.8.
Japan Patent Office, International Search Report for PCT/JP2016/086525 dated Mar. 7, 2017.

* cited by examiner

COATED BASE FABRIC FOR AIRBAG AND METHOD FOR MANUFACTURING SAME

CROSS-REFERENCE TO RELATED APPLICATIONS

This application is a U.S. National Phase application under 35 U.S.C. § 371 of International Patent Application No. PCT/JP2016/086525, filed on Dec. 8, 2016, which claims priority to Japanese Application No. 2015-244913, filed on Dec. 16, 2015. The entire contents of the parent applications are hereby incorporated by reference.

TECHNICAL FIELD

The present invention relates to coated fabrics used in airbags for automobiles, more specifically to coated fabrics for airbags that exhibit a small variation in air permeability in the width direction of the fabrics and methods for producing a coated fabric for airbags capable of reducing the variation in air permeability.

BACKGROUND ART

The installation of airbags is rapidly increasing these days as an automotive safety component. A sensor detects an impact in a vehicle collision and causes an inflator to generate a high-temperature and high-pressure gas, which immediately deploys airbags to prevent the body of the driver and the passengers, in particular their head, from hitting the steering wheel, front windshield, side windows, etc., and protect them. Recent years have seen increased practical use of not only airbags installed to the driver and passenger seats, but also other airbags, such as knee airbags, side airbags, and curtain airbags, and it is now common to install multiple airbags.

In particular, greater importance has been attached to curtain airbags from the occupant protection viewpoint. A fabric used for a curtain airbag is required to have a large area to extensively protect occupants, from those in the front seats to those in the rear seats. Conventionally used fabrics for airbags are typically about 150 cm in width, and because of this width, those fabrics cannot be cut along the width direction to have the length required for curtain airbags. Thus, curtain airbags are produced by cutting a cloth along its longitudinal direction to secure the length of the longitudinal direction of a curtain airbag, but cutting a cloth this way is not efficient. Thus, wider fabrics have been considered, and the production of coated fabrics with a width of 180 cm or more is underway.

However, increasing the width of non-coated fabrics (which may be hereinafter referred to as base fabrics) in order to prepare coated fabrics with a width of 180 cm or more leads to an increased variation of the fabrics, and the uniformity of coating in the width direction is also reduced, resulting in varied air permeability in the width direction. In particular, to obtain coated fabrics for airbags, the use of the knife-on-air method (also called the "floating knife coating method") is preferable from the standpoint of reducing the amount of coated resin and stable application of the resin. When a fabric is coated with a reduced amount of resin using this knife-on-air method, uniform tension must be applied to the base fabric in the width direction of the fabric during coating. However, due to the wider width, it is difficult to uniformly apply tension to a fabric in the width direction of the fabric, resulting in uneven air permeability in the width direction of the coated fabric.

To solve this problem, a patent is disclosed in which coating is performed such that the contact pressure between the knife and the woven fabric is within 1 to 15 N/cm, and the fabric tension is within 500 to 3000 N/m (PTL 1). The patent discloses that a suitable coating width of the base fabric is achieved when the contact pressure between the knife and the fabric, as well as the tension applied to the fabric, are within a predetermined range. However, the patent only focuses on the tension at the time the fabric is coated, and does not take into consideration variation in the entire width direction of the obtained coated fabric.

PTL 2 discloses a technique of applying higher tension to the selvages (the edge parts of a fabric) of the base fabric than to the middle part of the fabric in the width direction. Specifically, PTL 2 teaches that in order to apply high tension to the selvages, equipment called a "third support" is installed. This technique appears to be capable of applying certain tension in the width direction, but leaves streaks of coating in the bowed portion of the fabric because the fabric is coated with a portion of the fabric bowed, and also leads to varied air permeability in the width direction because of the difference in tension in the width direction including bowing.

As described above, it has been difficult to achieve uniform air permeability in the width direction of a coated fabric by the conventional methods when preparing a coated fabric having a coating amount of as low as 30 g/m$^2$ or less using a base fabric with a wide width of 180 cm or more.

CITATION LIST

Patent Literature

PTL 1: No. 4423853
PTL 2: JP2007-535432A

SUMMARY OF INVENTION

Technical Problem

An object of the present invention is to provide a coated fabric for airbags that exhibits uniform air permeability in the width direction even when using a fabric with a width of 180 cm or more, which has yet to be achieved by prior art.

Solution to Problem

The coated fabric for airbags of the present invention, which can solve the problems described above, includes the following subject matter.

Specifically, the present invention is as follows.

1. A coated fabric for airbags,
   the coated fabric comprising a woven fabric composed of synthetic fiber filaments and having an elastomer resin applied to at least one surface of the woven fabric,
   the coated fabric having an air permeability in the width direction of the coated fabric such that the maximum value of the air permeability is 1.5 times the average value or less.
2. The coated fabric for airbags according to item 1, having a bow and skew of 1.5% or less.
3. The coated fabric for airbags according to item 1 or 2, wherein the elastomer resin is a solvent-free addition polymerization silicone.
4. The coated fabric for airbags according to any one of items 1 to 3, wherein the amount of the applied elastomer resin is 1 to 30 g/m$^2$.

5. The coated fabric for airbags according to any one of items 1 to 4, wherein the total fineness of the filaments constituting the woven fabric is 200 to 600 dtex.

6. The coated fabric for airbags according to any one of items 1 to 5, wherein the cover factor of the woven fabric is 1,800 to 2,500.

7. A method for producing the coated fabric for airbags of any one of items 1 to 6, wherein the resin is applied by a knife-on-air method, and wherein the correlation between a fabric tension (Tp) applied in a stage before a resin coating step and a fabric tension (Ta) in the resin coating step is $0 \leq Ta - Tp \leq 300$ N/m.

8. The method for producing the coated fabric for airbags according to any one of items 1 to 7, wherein the resin is applied by a knife-on-air method, and wherein the fabric tension (Ta) in the resin coating step is 250 to 650 N/m.

9. The method for producing the coated fabric for airbags according to any one of items 1 to 8, wherein the resin is applied by a knife-on-air method, and wherein the fabric is treated at a temperature of 60 to 120° C. in the stage before the resin coating.

Advantageous Effects of Invention

The coated fabric for airbags of the present invention can achieve low air permeability even in the edge portions of the fabric even with a small amount of coating resin, and at the same time, can maintain uniform air permeability in the width direction even when the fabric is a wide fabric. In particular, the invention can provide a coated fabric for airbags excellent in fabric properties and appearance, reliability, and costs, even for curtain airbags, which are required to have especially high internal-pressure retention performance and a large fabric area.

DESCRIPTION OF EMBODIMENTS

Figure 1:
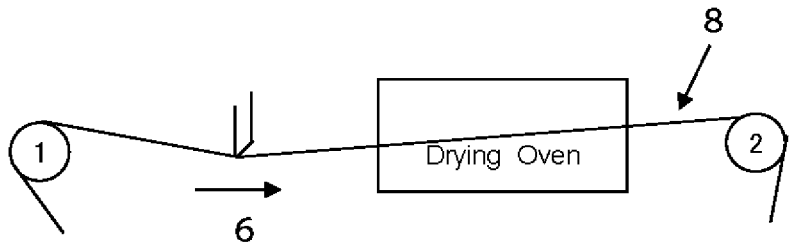
FIG. 1 is a schematic view illustrating a conventional coating step (one embodiment).

The following describes the present invention in detail. In the present invention, a woven fabric composed of synthetic fiber filaments refers to a fabric woven using a synthetic fiber filament yarn. The woven fabric is excellent in mechanical strength in the longitude and latitude directions, and also excellent in a thickness that can be made thin. The structure of the woven fabric may be, for example, a plain weave, a twill weave, a sateen weave, a variation of these weaving patterns, a multiaxial woven pattern, or the like; of these, a plain-weave fabric, which is excellent in mechanical strength and low air permeability achievement, is particularly preferable.

Usable synthetic fibers include, in particular, aliphatic polyamide fibers, such as nylon 66, nylon 6, nylon 46, and nylon 12; aromatic polyamide fibers, such as aramid fibers; and polyester fibers, such as polyethylene terephthalate, polytrimethylene terephthalate, and polybutylene terephthalate. Additionally, synthetic fibers include wholly aromatic polyester fibers, poly(p-phenylene benzobisoxazole) fibers (PEO fibers), ultrahigh-molecular-weight polyethylene fibers, polyphenylene sulfide fibers, and polyether ketone fibers. From an economical viewpoint, polyester fibers and polyamide fibers are preferable, and nylon 66 fibers are particularly preferable. These fibers may be obtained from a starting material, part or all of which is a recycled material.

These synthetic fibers may contain various additives in order to make it easier for fibers to undergo the original yarn production step and post-processing step. Examples of additives include antioxidants, heat stabilizers, smoothing agents, antistatic agents, thickening agents, and flame retardants. These synthetic fibers may be solution-dyed yarns or yarns dyed after spinning. The cross-sectional surface of a single yarn may be a typical round cross-section or irregular cross-section. For the synthetic fiber, it is preferable to use a multifilament yarn containing 72 filaments or more and 216 filaments or less, from the standpoint of flexibility and smoothness of the coated surface.

The boiling-water shrinkage rate of an original yarn for use is preferably 5 to 10% from the standpoint of obtaining a high-quality fabric with fewer creases. When the boiling-water shrinkage rate of an original yarn is less than 5%, shrinkage of the original yarn in the post-weaving processing treatment does not close the interstices of the woven fabric that is not coated yet (which is hereinafter referred to as a base fabric), thereby resulting in a fabric prone to increased air permeability or loose seams. When the shrinkage rate exceeds 10%, interstices are more likely to be closed in the post-weaving processing treatment; however, spinnability is extremely reduced. The boiling-water shrinkage rate is more preferably 5.5 to 9.5%.

A loom used for weaving a base fabric may be an existing loom, such as a water-jet loom, an air jet loom, and a rapier loom, and for a loom with shedding motion, a known machine, such as a Jacquard loom, may be used. A water-jet loom is preferably used because it substantially removes the oil agent component, thereby giving a woven fabric having a suitable amount of the oil agent component adhered thereto. However, other looms may also be used without any particular problem because the excess oil agent component, glue, and stain can be removed by the scouring step.

The woven fabric may be allowed to pass through a high-temperature water tank at 70 to 98° C. for a time period of 1 second or more and 10 minutes or less in order to fully shrink the fabric. It is more preferable to apply running tension only in the traveling direction when the fabric undergoes this step in order to fully shrink the weft without extending the fabric in the weft direction. Thereafter, the fabric is dried until the water content reaches a predetermined amount in a drying step, thereby obtaining a base fabric for a coated fabric.

The coating resin applied to the base fabric is preferably a thermosetting elastomer resin that has heat resistance, cold resistance, and flame retardancy, and most preferably a silicone based-resin. Specific examples of silicone based-resins include addition polymerization silicone rubber, such as dimethyl silicone rubber, methyl vinyl silicone rubber, methylphenyl silicone rubber, trimethyl silicone rubber, fluorosilicone rubber, methyl silicone resin, methylphenyl silicone resin, methyl vinyl silicone resin, epoxy-modified silicone resin, acrylic-modified silicone resin, and polyester-modified silicone resin. Of these, methyl vinyl silicone rubber is suitable because the rubber exhibits rubber elasticity after being cured, excellent strength and stretchability, and a cost-wise advantage.

In the present invention, the silicone based-resin for use preferably has a resin viscosity of 5 to 40 Pa·sec, and more preferably 7 to 35 Pa·sec. A resin viscosity of more than 40 Pa·sec is not preferable because it requires extra tension in the warp direction to achieve a coating amount of 30 g/m$^2$ or less and may damage the fabric. A resin viscosity of less than 5 Pa·sec is also not preferable because the resin seeps into the base fabric, increasing the amount of resin adhered to the fabric, while making it difficult to achieve a desired air permeability. As long as the viscosity can be adjusted to fall within the ranges described above, either a solvent-based resin or a solvent-free resin may be used. However, a solvent-free resin may be preferable, given the environmental impact.

Organohydrogenpolysiloxane constituting a silicone based-resin undergoes a hydrosilylation addition reaction with an alkenyl-containing polysiloxane to thereby act as a crosslinking agent. The molecular structure of the organohydrogenpolysiloxane may be, for example, a linear structure, a cyclic structure, a branched structure, or a three-dimensional network.

When a silicone based-resin is used, a reaction curing agent may be used. Typical examples include platinum and platinum compound catalysts (platinum-based catalysts). A known reaction curing agent may be used, and specific examples include platinum black, chloroplatinic acid, alcohol modified products of chloroplatinic acid, and complexes of chloroplatinic acid with olefin, aldehyde, vinyl siloxane, or an acetylene alcohol. The more a platinum compound catalyst is mixed, the more the hydrosilylation reaction is promoted. Typically, 100 to 2000 ppm of a platinum compound catalyst (on a platinum metallic amount basis) relative to a composition is added.

To improve the adhesiveness of the silicone based-resin and the base fabric, it is preferable to add an adhesive aid to the silicone based-resin. The adhesive aid is, for example, at least one member selected from the group consisting of amino-based silane coupling agents, epoxy-modified silane coupling agents, vinyl-based silane coupling agents, chloro-based silane coupling agents, and mercapto-based silane coupling agents. However, the adhesive aid is not limited to these examples.

Optionally, a reinforcing inorganic filler, such as fumed silica and dry silica, a crosslinkable silicone (silicone resin) having adjusted terminal groups, a non-reinforcing inorganic filler, such as calcium carbonate, calcium silicate, and titanium dioxide, for example, may also be added. The amount of an inorganic filler for use is 0.1 to 200 parts by mass, and particularly preferably 0.1 to 100 parts by mass, based on the alkenyl-containing polysiloxane component.

Additionally, an inorganic pigment or an organic pigment may be added as a colorant. Examples of inorganic pigments include carbon black, titanium oxide, aka bengara (red pigment), kuro bengara (black pigment), titanium yellow, and cobalt blue, and examples of organic pigments include condensed azo pigments (yellow, brown, red), isoindolinone pigments (yellow, orange), quinacridone pigments (red, purple), diketopyrrolopyrrole pigments (orange, red, purple), anthraquinone pigments (yellow, red, blue), dioxazine pigments (purple), benzimidazolone pigments (orange), copper phthalocyanine pigments (blue), and allyl amide pigments (yellow).

In the present invention, even when additives other than the resin are added, the viscosity of the resin composition (i.e., the viscosity of the resin actually applied to the base fabric) is considered to be "the viscosity of the resin."

In the present invention, in order to reduce variation of air permeability in the width direction, the base fabric tension at the time of coating must be within a predetermined range. A known resin coating method may be used to apply the resin. Taking into consideration the ease of adjustment of the coating amount and the impact of foreign matter (protruding objects) contamination, knife coating, in particular a knife-on-air method, is preferable as a coating method. When a knife-on-bed method is used, resin easily seeps inside the base fabric. However, it is difficult to allow resin to be present on the surface of the base fabric (the surface of the fabric to be coated), in particular the top portion, thereby failing to achieve the reduced permeability generally required for the coated fabric. In the present invention, the edge portion of the knife used in knife coating may have a semicircular shape, a square shape, and the like.

The mechanism of knife coating by the conventional knife-on-air method is that resin on a fabric is scraped off with a knife. Thus, a focus has been placed only on the tension at the time resin is applied to the fabric with a knife (which may hereinafter be referred to as "at the time of coating") in coating. A reduction in the amount of resin adhered to the fabric (i.e., a reduction in the amount of coating) has also been required in order to improve the packageability and cost performance. To reduce the amount of coating, the tension applied to the fabric at the time of coating is likely to be high. Although setting a high fabric tension enables a desired amount of resin to adhere to the fabric, thermal shrinkage of the fabric in a drying oven after application of resin promotes distortion in the width direction, resulting in creases in the fabric and a failure to achieve uniform air permeability. Thus, the inventor found that a focus only on the tension at the time of coating leads to a lack of uniformity in the width direction, and arrived at the present invention.

In the present invention, the inventor found that applying tension not only at the time of coating, but also at the base fabric feeding step, which is the stage before the coating step, (i.e., applying tension stepwise onto the base fabric) increases the uniformity of the coated fabric. The inventor found the following novel technical concept that has not been solved by prior art: the present invention enables a reduction of tension at the time resin is applied by a knife-on-air method, which leads to a uniform amount of coating in the width direction, thus resulting in reduced variation of air permeability.

In the present invention, when the tension at the time of coating is Ta and the tension applied before coating is Tp, it is preferable to satisfy the following: $0 \leq Ta - Tp \leq 300$ N/m. A difference between Ta and Tp exceeding 300 N/m is not preferable because it does not contribute to an improvement in the smoothness of the base fabric, and cannot reduce a variation of air permeability in the width direction. The difference between Ta and Tp is preferably 280 N/m or less, and more preferably 250 N/m or less. Ta and Tp may be equal, but Tp higher than Ta is not preferable because it may increase the likelihood of causing a strain of the base fabric due to relaxed tension on the base fabric at the time of coating, leading to deteriorated air permeability and bow and skew performance.

In the present invention, the "tension Ta at the time of coating" refers to the tension at the time resin is applied to the fabric, and the "tension Tp applied before coating" refers to the maximum tension applied to the fabric during the steps preceding application of resin by knife on air.

The use of the method according to the present invention can reduce the tension at the time of coating. The tension Ta at the time of coating is preferably within the range of 250 to 650 N/m. A tension lower than 250 N/m is not preferable because it makes it difficult to achieve a predetermined amount of coating. The tension Ta at the time of coating is preferably 300 N/m or more. A tension higher than 650 N/m is not preferable because the fabric undergoes the coating and drying steps with its strain being increased, thereby deteriorating air permeability and bow and skew performance. The tension Ta at the time of coating is preferably 550 N/m or less, more preferably 500 N/m or less, and more preferably 450 N/m or less.

The base fabric may be allowed to travel over a heated roller at the stage before the fabric is subjected to knife coating. The temperature of the base fabric before coating is not particularly limited as long as the temperature does not cause a change in the density of the fabric depending on its association with the tension applied to the base fabric before coating. A set temperature of the roller of 60° C. or more is preferable because it leads to the uniformity of the entire fabric due to the addition of the temperature, increasing the uniformity of the coated fabric. The temperature of the roller is more preferably 80° C. or more, and still more preferably 100° C. or more. The upper limit is, although not particularly limited thereto, preferably 120° C. or less otherwise a curing reaction may occur at an undesired timing to cause the applied coating agent to cure, possibly impeding the uniformity of the coated fabric. The upper limit is more preferably 115° C. or less, and still more preferably 110° C. or less.

A feature of the coated fabric of the present invention is its small variation of air permeability in the width direction. The air permeability in the width direction is measured by equally dividing the coated fabric in the width direction into twelve portions, and measuring the air permeability at the middle point of each divided portion except for the portion at each end (i.e., 10 points in total) under a differential pressure of 20 kPa. From the measured values, the maximum value and the average value were determined. The maximum value of air permeability in the width direction of the coated fabric of the present invention is 1.5 times the average value or less, preferably 1.4 times the average value or less, more preferably 1.3 times the average value or less, and still more preferably 1.2 times the average value or less. When the maximum value of air permeability in the width direction is 1.5 times the average value or less, the difference in air permeability in the width direction is small, reducing the variation between cut fabric pieces, and providing a stable airbag.

The method for measuring the air permeability of a coated fabric for airbags is described later. To avoid the overlap of measurement area determined by dividing the fabric in twelve portions, the fabric is required to have a width of at least 120 cm or more, preferably 150 cm or more, and more preferably 180 cm or more. The upper limit for the width of the fabric is not limited, but is preferably 280 cm or less, and more preferably 250 cm or less, given the width of the looms used at present.

The bow and skew prescribed in JIS L1096 8.12 of the coated fabric for airbags of the present invention is preferably 1.5% or less. A bow and skew of 1.5% or less shows little distortion in the fabric. The bow and skew is preferably 1.4% or less, more preferably 1.3% or less, and still more preferably 1.2% or less. The reason why the bow and skew is suppressed to 1.5% or less in the present invention is probably because the stepwise application of tension, which begins before coating, makes the base fabric before coating uniform, minimizing the distortion.

The method for drying and curing the applied coating agent may be a typical heating method, such as with hot air, infrared light, and microwaves. Regarding the heating temperature and time period, it is sufficient if the temperature reaches the point at which the elastomer resin is cured. Preferably, the heating temperature is 150 to 220° C., and the heating time period is 0.2 to 5 minutes.

The amount of the elastomer resin coated onto the fabric is preferably 1 to 30 g/m$^2$. An amount of less than 1 g/m$^2$ is not preferable because it cannot maintain the airtightness of the coated fabric. The amount of coated elastomer resin is more preferably 3 g/m$^2$ or more, and still more preferably 5 g/m$^2$ or more. An amount of coated elastomer resin of more than 30 g/m$^2$ is not preferable because it is likely to impair the lightweightness and packageability. The amount of coated elastomer resin is more preferably 25 g/m$^2$ or less, and still more preferably 20 g/m$^2$ or less.

The total fineness of the filament yarns constituting the woven fabric (base fabric) is preferably 200 to 600 dtex. A total fineness of more than 600 dtex increases the thickness of the woven fabric (base fabric), more likely decreasing the packageability of the airbag. The total fineness is more preferably 500 dtex or less. A total fineness of less than 200 dtex is likely to decrease the mechanical characteristics of airbags, such as the tensile strength and tear strength of the coated fabric for airbags. The total fineness is more preferably 300 dtex or more.

The cover factor of the woven fabric (base fabric) is preferably 1,800 to 2,500, and more preferably 1,900 to 2,450. A cover factor of less than 1,800 decreases the physical characteristics (e.g., tear strength) required of airbags, while a cover factor of more than 2,500 places a limitation on the weaving process and packageability.

EXAMPLES

The following describes the present invention in detail with reference to Examples. However, the present invention is not limited the Examples. The various evaluations described in the Examples were performed in accordance with the following methods.

(1) Total Fineness

The total fineness was measured in accordance with the method prescribed in JIS L-1095 9.4.1.

(2) Number of Filaments

The number of filament yarns on a photograph of the cross-sectional surface was counted.

(3) Density of Woven Fabric

The density of the woven fabric was measured in accordance with the method prescribed in JIS L-1096 8.6.1.

(4) Cover Factor (CF)

$$CF=\sqrt{(\text{a total fineness of the warp})}\times\text{warp density}+\sqrt{(\text{a total fineness of the weft})}\times\text{weft density}$$

The unit for the total fineness is dtex, and the unit for the weaving density is yarn/2.54 cm.

(5) Coating Amount

A coated fabric, after the applied elastomer resin was cured, was sampled as a 5 cm×5 cm piece, and immersed in a solvent for dissolving only the fibers of the base fabric (e.g., the solvent for polyamide 66 is hexafluoroisopropanol) to allow the base fabric to dissolve. Subsequently, only the elastomer resin layer, which is an insoluble matter, was recovered, and washed with acetone, followed by vacuum drying and measuring the sample weight. The amount of coating is indicated by mass per m$^2$ (g/m$^2$).

(6) Air Permeability of Coated Fabric in Width Direction

A coated fabric was equally divided into twelve portions in the width direction, and the ventilation volume at the middle point of each divided portion except for the portion at each end (i.e., 10 points in total) was measured under a differential pressure of 20 kPa. A high-pressure air permeability tester (produced by OEM Systems) was used for the measurement. To use this tester, a measurement area of at least about 10 cm×10 cm is required. To avoid the overlap of measurement points, a sample with a width of at least 120 cm or more is necessary. From the 10 values in the middle points, the average value and the maximum value were determined.

(7) Bow and Skew

The bow and skew was measured in accordance with the method prescribed in JIS L-1096 8.12.

(8) Fabric Temperature

The temperature of the base fabric before coating was measured with a non-contact infrared thermometer at the point of 15 cm upstream from the position of a knife blade.

Example 1

A plain-weave fabric was woven with a nylon 66 multifilament yarn containing 140 filaments that had an original yarn strength of 8.0 cN/dtex and a total fineness of 470 dtex, using a water-jet loom. Subsequently, the fabric was subjected to shrinkage processing with boiling water at 95° C. and dry finishing at 130° C., thereby obtaining a woven fabric with a warp density of 46 yarns/2.54 cm, a weft density of 46 yarns/2.54 cm, a cover factor of 1,994, and a width of 203 cm.

Figure 2:
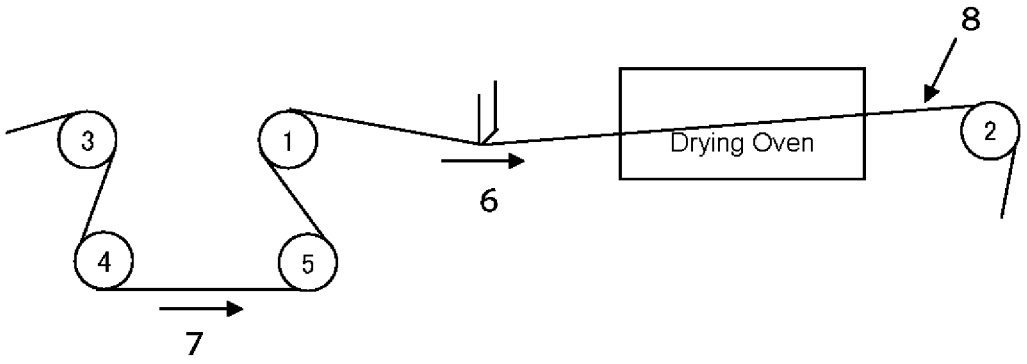
FIG. 2 is a schematic view illustrating a coating step of the present invention (one embodiment).

This woven fabric (base fabric) was coated with an apparatus such as that shown in FIG. 2. The fabric tension (Tp) in the stage before the resin coating was 350 N/m, and the fabric tension (Ta) in the resin coating step was 500 N/m. The temperature of the heating rollers in the stage before the resin coating was 80° C.

A solvent-free addition polymerization vinyl methyl silicone resin having a resin viscosity of 10 Pa·sec was applied to one side of this woven fabric (base fabric) by a knife-on-air method. Subsequently, curing treatment was performed at 200° C. for 1 minute, thereby obtaining a coated fabric having a coating amount of 15 g/m$^2$.

The characteristics of the obtained coated fabric were evaluated, and Table 1 shows the results. The obtained coated fabric had a small variation in air permeability in the width direction and a low bow and skew, exhibiting excellent performance and fabric properties and appearance.

Example 2

A plain-weave fabric was woven with a nylon 66 multifilament yarn containing 72 filaments that had an original yarn strength of 8.1 cN/dtex and a total fineness of 470 dtex, using a water-jet loom. Subsequently, the fabric was subjected to shrinkage processing with boiling water at 95° C. and dry finishing at 130° C., thereby obtaining a woven fabric with a warp density of 46 yarns/2.54 cm, a weft density of 46 yarns/2.54 cm, a cover factor of 1,994, and a width of 195 cm.

This woven fabric (base fabric) was coated in the same manner as in Example 1. The fabric tension (Tp) in the stage before the resin coating was 130 N/m, and the fabric tension (Ta) in the resin coating step was 340 N/m. The temperature of the heating rollers in the stage before the resin coating was 100° C.

Subsequently, the same resin as the resin used in Example 1 was applied to one side of this woven fabric (base fabric) by a knife-on-air method. Curing treatment was then performed at 200° C. for 1 minute, thereby obtaining a coated fabric having a coating amount of 26 g/m$^2$.

The characteristics of the obtained coated fabric were evaluated, and Table 1 shows the results. The obtained coated fabric had a small variation in air permeability in the width direction and a low bow and skew, exhibiting excellent performance and fabric properties and appearance.

Example 3

A plain-weave fabric was woven with a nylon 66 multifilament yarn containing 140 filaments that had an original yarn strength of 8.0 cN/dtex and a total fineness of 350 dtex, using a water-jet loom. Subsequently, the fabric was subjected to shrinkage processing with boiling water at 95° C. and dry finishing at 130° C., thereby obtaining a woven fabric with a warp density of 55 yarns/2.54 cm, a weft density of 55 yarns/2.54 cm, a cover factor of 2,058, and a width of 200 cm.

This woven fabric (base fabric) was coated in the same manner as in Example 1. The fabric tension (Tp) in the stage before the resin coating was 300 N/m, and the fabric tension (Ta) in the resin coating step was 450 N/m. The temperature of the heating rollers in the stage before the resin coating was 80° C.

Subsequently, the same resin as the resin used in Example 1 was applied to one side of this woven fabric (base fabric) by a knife-on-air method. Curing treatment was then performed at 200° C. for 1 minute, thereby obtaining a coated fabric having a coating amount of 25 g/m$^2$.

The characteristics of the obtained coated fabric were evaluated, and Table 1 shows the results. The obtained coated fabric had a small variation in air permeability in the width direction and a low bow and skew, exhibiting excellent performance and fabric properties and appearance.

Example 4

A plain-weave fabric was woven with a nylon 66 multifilament yarn containing 108 filaments that had an original yarn strength of 8.4 cN/dtex and a total fineness of 350 dtex, using a water-jet loom. Subsequently, the fabric was subjected to shrinkage processing with boiling water at 95° C. and dry finishing at 130° C., thereby obtaining a woven fabric with a warp density of 59 yarns/2.54 cm, a weft density of 59 yarns/2.54 cm, a cover factor of 2,208, and a width of 199 cm.

This woven fabric (base fabric) was coated in the same manner as in Example 1.

Subsequently, the same resin as the resin used in Example 1 was applied to one side of this woven fabric (base fabric) by a knife-on-air method. Curing treatment was then performed at 200° C. for 1 minute, thereby obtaining a coated fabric having a coating amount of 15 g/m$^2$.

The characteristics of the obtained coated fabric were evaluated, and Table 1 shows the results. The obtained coated fabric had a small variation in air permeability in the width direction and a low bow and skew, exhibiting excellent performance and fabric properties and appearance.

Example 5

A plain-weave fabric was woven with a nylon 66 multifilament yarn containing 72 filaments that had an original yarn strength of 8.4 cN/dtex and a total fineness of 235 dtex, using a water-jet loom. Subsequently, the fabric was subjected to shrinkage processing with boiling water at 95° C. and dry finishing at 130° C., thereby obtaining a woven fabric with a warp density of 73 yarns/2.54 cm, a weft density of 73 yarns/2.54 cm, a cover factor of 2,238, and a width of 202 cm.

This woven fabric (base fabric) was coated in the same manner as in Example 1. The fabric tension (Tp) in the stage before the resin coating was 270 N/m, and the fabric tension (Ta) in the resin coating step was 470 N/m. The temperature of the heating rollers in the stage before the resin coating was 80° C.

Subsequently, the same resin as the resin used in Example 1 was applied to one side of this woven fabric (base fabric) by a knife-on-air method. Curing treatment was then performed at 200° C. for 1 minute, thereby obtaining a coated fabric having a coating amount of 15 g/m$^2$.

The characteristics of the obtained coated fabric were evaluated, and Table 1 shows the results. The obtained coated fabric had a small variation in air permeability in the width direction and a low bow and skew, exhibiting excellent performance and fabric properties and appearance.

Example 6

A plain-weave fabric was woven with a nylon 66 multifilament yarn containing 144 filaments that had an original yarn strength of 8.4 cN/dtex and a total fineness of 470 dtex, using a water-jet loom. Subsequently, the fabric was subjected to shrinkage processing with boiling water at 95° C. and dry finishing at 130° C., thereby obtaining a woven fabric with a warp density of 53 yarns/2.54 cm, a weft density of 53 yarns/2.54 cm, a cover factor of 2,298, and a width of 240 cm.

This woven fabric (base fabric) was coated in the same manner as in Example 1.

The fabric tension (Tp) in the stage before the resin coating was 400 N/m, and the fabric tension (Ta) in the resin coating step was 600 N/m. The temperature of the heating rollers in the stage before the resin coating was 100° C.

Subsequently, the same resin as the resin used in claim 1 was applied to one side of this woven fabric (base fabric) by a knife-on-air method. Curing treatment was then performed at 200° C. for 1 minute, thereby obtaining a coated fabric having a coating amount of 7 g/m$^2$.

The characteristics of the obtained coated fabric were evaluated, and Table 1 shows the results. The obtained coated fabric had a small variation in air permeability in the width direction and a low bow and skew, exhibiting excellent performance and fabric properties and appearance.

Example 7

The same woven fabric (base fabric) as in Example 4 was coated in the same manner as in Example 4. The temperature of the heating rollers in the stage before the resin coating was not applied, and the fabric was processed at room temperature.

The characteristics of the obtained coated fabric were evaluated, and Table 1 shows the results. The obtained coated fabric had slightly more variation in air permeability in the width direction and a slightly higher bow and skew than the fabric obtained in Example 4, but exhibited sufficiently excellent performance and fabric properties and appearance.

Comparative Example 1

The same woven fabric (base fabric) as in Example 1 was coated with an apparatus such as that shown in FIG. 1. Thus, tension was not applied to the fabric in the stage before the resin coating and the heating rollers were also not used (running tension: Tp=20).

The characteristics of the obtained coated fabric were evaluated, and Table 1 shows the results. Although the coating amount was 17 g/m$^2$, the maximum value of the air permeability was as high as 2.5 times the average value of the air permeability, and the bow and skew was also as high as 1.8%. Thus, the obtained coated fabric was not preferable. The probable reason for the results is that because a high tension was applied to the woven fabric (base fabric) in a single step, and then the fabric was allowed to pass through the coating and drying steps under the high tension, the strain of the fabric increased, which led to a higher (deteriorated) air permeability and bow and skew.

Comparative Example 2

The same woven fabric (base fabric) as in Example 2 was coated in the same manner as in Example 1. The tension in the stage before the resin coating was a running tension (Tp=50), and the fabric tension (Ta) in the resin coating step was 550 N/m. The temperature of the heating rollers in the stage before the resin coating was 130° C. The coating amount was 25 g/m$^2$.

The characteristics of the obtained coated fabric were evaluated, and Table 1 shows the results. The obtained coated fabric was not preferable because the variation of air permeability in the width direction was large, and the bow and skew was also high. The probable reason for this is that although heat was applied in the stage before the resin coating, a high tension was applied to the woven fabric (base fabric) in a single step, and the fabric was allowed to pass through the coating and drying steps under the high tension, the strain of the fabric increased, which led to a higher (deteriorated) air permeability and bow and skew.

Comparative Example 3

The same woven fabric (base fabric) as in Example 4 was coated in the same manner as in Example 4. The fabric tension (Tp) in the stage before the resin coating was 450 N/m, and the fabric tension (Ta) in the resin coating step was 400 N/m. The temperature of the heating rollers in the stage before the resin coating was 80° C.

Subsequently, the same resin as the resin of claim 4 was applied to one side of this woven fabric (base fabric) by a knife-on-air method. Curing treatment was then performed at 200° C. for 1 minute, thereby obtaining a coated fabric having a coating amount of 27 g/m$^2$.

The characteristics of the obtained coated fabric were evaluated, and Table 1 shows the results. The obtained coated fabric was not preferable because it had a large variation of air permeability in the width direction. The probable reason for this is that a high tension was applied to the fabric at the Tp stage, and then the tension was relaxed at the Ta stage, which caused wavy selvages, leading to higher air permeability in the edge portions of the fabric.

Comparative Example 4

The same woven fabric (base fabric) as in Example 1 was coated in the same manner as in Example 1. The fabric tension (Tp) in the stage before the resin coating was 220 N/m, and the fabric tension (Ta) in the resin coating step was 600 N/m. The temperature of the heating rollers in the stage before the resin coating was 80° C.

Subsequently, the same resin as the resin used in Example 1 was applied to one side of this woven fabric (base fabric) by a knife-on-air method. Curing treatment was then performed at 200° C. for 1 minute, thereby obtaining a coated fabric having a coating amount of 16 g/m$^2$.

The characteristics of the obtained coated fabric were evaluated, and Table 1 shows the results. The obtained coated fabric was not preferable because it had a large variation of air permeability in the width direction and high bow and skew. The probable reason for this is that although a tension was apparently applied to the woven fabric (base fabric) two times, the impact of the tensions became equivalent to the tension applied at one time due to the overly large difference between the first and second tensions. Thus, the strain of the fabric appeared to be increased, which led to higher (deteriorated) air permeability and bow and skew.

INDUSTRIAL APPLICABILITY

The coated fabric for airbags of the present invention can maintain a uniform air permeability in the width direction even if the fabric is wide; thus, when the fabric is used in airbags, which are required, in particular, to have high internal-pressure retention performance, the airbags exhibit excellent fabric properties and appearance and reliability. The fabric also reduces loss in the cutting process and exhibits excellent cost performance. Therefore, the fabric makes a great contribution on an industrial scale.

DESCRIPTION OF THE REFERENCE NUMERALS

1 A driving roller for determining the rate of the coating step

2 A roller for adjusting the fabric tension in the resin coating step

TABLE 1

| | | | Ex. 1 | Ex. 2 | Ex. 3 | Ex. 4 | Ex. 5 | Ex. 6 |
|---|---|---|---|---|---|---|---|---|
| Total Fineness | | dtex | 470 | 470 | 350 | 350 | 235 | 470 |
| Number of Filaments | | Yarn | 140 | 72 | 140 | 108 | 72 | 144 |
| Weaving Density (Warp/Weft) | | Yarn/2.54 cm | 46/46 | 46/46 | 55/55 | 59/59 | 73/73 | 53/53 |
| Cover Factor | | — | 1,994 | 1,994 | 2,058 | 2,208 | 2,238 | 2,298 |
| Coating Amount | | g/m$^2$ | 15 | 26 | 25 | 15 | 15 | 7 |
| Tension at the Time of Coating | Fabric Tension Tp in the Stage Before the Resin Coating | N/m | 350 | 130 | 300 | 350 | 270 | 400 |
| | Fabric Tension Ta in the Resin Coating Step | N/m | 500 | 340 | 450 | 500 | 470 | 600 |
| | Ta − Tp | N/m | 150 | 210 | 150 | 150 | 200 | 200 |
| Heating Roller Temperature | | ° C. | 80 | 100 | 80 | 80 | 80 | 100 |
| Permeability of Coated Fabric in the Width Direction (Average) | | L/cm$^2$/min | 0.005 | 0.002 | 0.001 | 0.001 | 0.002 | 0.022 |
| Permeability of Coated Fabric in the Width Direction (Maximum) | | L/cm$^2$/min | 0.007 | 0.003 | 0.001 | 0.001 | 0.003 | 0.024 |
| Variation in Permeability of Coated Fabric in the Width Direction (Maximum/Average) | | — | 1.4 | 1.4 | 1.2 | 1.0 | 1.5 | 1.1 |
| Bow and Skew | | % | 1.0 | 0.5 | 0.8 | 0.6 | 1.1 | 1.3 |

| | | | Ex. 7 | Comp. Ex. 1 | Comp. Ex. 2 | Comp. Ex. 3 | Comp. Ex. 4 |
|---|---|---|---|---|---|---|---|
| Total Fineness | | dtex | 350 | 470 | 470 | 350 | 470 |
| Number of Filaments | | Yarn | 108 | 140 | 72 | 108 | 140 |
| Weaving Density (Warp/Weft) | | Yarn/2.54 cm | 59/59 | 46/46 | 46/46 | 55/55 | 46/46 |
| Cover Factor | | — | 2,208 | 1,994 | 1,994 | 2,058 | 1,944 |
| Coating Amount | | g/m$^2$ | 15 | 17 | 25 | 27 | 16 |
| Tension at the Time of Coating | Fabric Tension Tp in the Stage Before the Resin Coating | N/m | 350 | 20 | 50 | 450 | 220 |
| | Fabric Tension Ta in the Resin Coating Step | N/m | 500 | 700 | 550 | 400 | 650 |
| | Ta − Tp | N/m | 150 | 680 | 500 | −50 | 430 |
| Heating Roller Temperature | | ° C. | RT | RT | 130 | 80 | 80 |
| Permeability of Coated Fabric in the Width Direction (Average) | | L/cm$^2$/min | 0.001 | 0.004 | 0.003 | 0.024 | 0.025 |
| Permeability of Coated Fabric in the Width Direction (Maximum) | | L/cm$^2$/min | 0.001 | 0.010 | 0.006 | 0.065 | 0.055 |
| Variation in Permeability of Coated Fabric in the Width Direction (Maximum/Average) | | — | 1.3 | 2.5 | 2.0 | 2.7 | 2.2 |
| Bow and Skew | | % | 0.8 | 1.8 | 1.9 | 1.8 | 1.6 |

Note:

The abbreviation "Ex." Indicates Example, and "Comp. Ex." indicates Comparative Example.

The abbreviation "RT" indicates room temperature.

3 A roller for adjusting the fabric tension in the stage before the resin coating

4,5 Rollers for adjusting the temperature in the stage before the resin coating

6 Fabric tension (Ta) in the resin coating step

7 Fabric tension (Tp) in the stage before the resin coating

8 A fabric

The invention claimed is:

1. A coated fabric for airbags, the coated fabric comprising a woven fabric composed of synthetic fiber filaments and having an elastomer resin applied to at least one surface of the woven fabric, the coated fabric having an air permeability in the width direction of the coated fabric such that the maximum value of the air permeability is 1.5 times the average value or less.

2. The coated fabric for airbags according to claim 1, having a bow and skew of 1.5% or less.

3. The coated fabric for airbags according to claim 1, wherein the elastomer resin is a solvent-free addition polymerization silicone.

4. The coated fabric for airbags according to claim 1, wherein the amount of the applied elastomer resin is 1 to 30 $g/m^2$.

5. The coated fabric for airbags according to claim 1, wherein the total fineness of the filaments constituting the woven fabric is 200 to 600 dtex.

6. The coated fabric for airbags according to claim 1, wherein the cover factor of the woven fabric is 1,800 to 2,500.

7. A method for producing the coated fabric for airbags of claim 1, comprising:

a base fabric feeding step comprising applying a fabric tension (Tp) to the woven fabric; and a resin coating step comprising applying the resin to at least one surface of the woven fabric by a knife-on-air method after the base fabric feeding step, wherein the correlation between the fabric tension (Tp) and a fabric tension (Ta) in the resin coating step is $0 \leq Ta - Tp \leq 300$ N/m.

8. The method for producing the coated fabric for airbags according to claim 7, wherein the fabric tension (Ta) in the resin coating step is 250 to 650 N/m.

9. The method for producing the coated fabric for airbags according to claim 7, wherein a temperature of 60 to 120° C. is applied to the fabric in the base fabric step.

* * * * *